United States Patent [19]

Laube

[11] Patent Number: 4,531,291

[45] Date of Patent: Jul. 30, 1985

[54] ANIMAL GROOMING CLIPPER

[75] Inventor: Kim E. Laube, Panorama City, Calif.

[73] Assignee: Kelly Crisp, Canoga Park, Calif.

[21] Appl. No.: 444,867

[22] Filed: Nov. 29, 1982

[51] Int. Cl.[3] ..... B26B 19/02

[52] U.S. Cl. ..... 30/216; 30/219; 30/231; 30/296 A; 269/16

[58] Field of Search ..... 30/216, 219, 220, 210, 30/201, 202, 200, 228, 241, 242, 290 R, 273, 296 A, 231; 83/574, 701; 269/16, 76, 97; 248/226.4; 408/127

[56] References Cited

U.S. PATENT DOCUMENTS 1,615,328 1/1927 Fewins ..... 30/228 X
2,584,620 2/1952 Rubin ..... 30/296 R X
4,167,264 9/1979 Kretzmeir ..... 269/16

FOREIGN PATENT DOCUMENTS 560112 9/1932 Fed. Rep. of Germany ..... 30/219

*Primary Examiner*—Douglas D. Watts
*Attorney, Agent, or Firm*—Ralph B. Pastoriza

[57] ABSTRACT

The clipper is driven by a flexible shaft from a stationary motor supported by a stand clamped to an edge of a grooming table. Because the motor is not incorporated in the clipper casing as characterizes prior art clippers, the casing is lighter, operates at a cooler temperature and can be made more powerful by utilizing a motor of higher rated horsepower and rpm than the smaller type motors incorporated in a clipper casing.

6 Claims, 7 Drawing Figures

ANIMAL GROOMING CLIPPER

FIELD OF THE INVENTION

This invention relates to clipper devices and more particularly to animal grooming clippers.

BACKGROUND OF THE INVENTION

Most conventional clippers for grooming animals incorporate an electric motor within a casing for driving the clipper blades. These blades constitute a clipper blade assembly wherein there are provided stationary blade teeth and movable blade teeth, the movable blade teeth having a small receiving cavity for a finger which is caused to oscillate back and forth and thereby effect relative movement between the blades. Such a blade assembly can be received in an appropriate clipper blade assembly holder provided on the casing itself. The manner of attaching and detaching such blade assemblies to a clipper in a proper position such that a driving finger can be received in an appropriate cavity to drive the movable clipper blade teeth is well known in the art. Usually, the rotation of the motor shaft in the casing is converted through appropriate helical gears into an oscillating motion of the drive finger to thereby drive the blades.

As a consequence of the foregoing configuration, the clipper after prolonged use can become heated not only as a consequence of the presence of the motor itself in the casing but also because of heat developed in the driving of the gear train to oscillate the blades. The developed heat as well as the general bulk of the clipper as a result of having to move the motor with the clipper itself makes it difficult for a person to use the clipper for prolonged periods. Further, in order to resist the developed heat, such prior art clippers have had to have a specially designed plastic type casing material which is heat resistant. Unfortunately, this type of material is subject to shattering should the clipper be inadvertently dropped.

In order to minimize the foregoing disadvantages, the motor carried within the clipper casing has been made as small and as light as is practical. While improvement is achieved by using a small and light motor, there is a sacrifice in the power available to drive the clipper blades and under a load such as a heavy coat of hair to be sheared, the oscillation frequency of the blades can be slowed considerably, thereby making the cutter less efficient. Moreover, after prolonged use, the gear train arrangement for converting the rotary motion of the motor to the oscillating motion required to drive the cutter blades become worn and as a result the overall amplitude of oscillation decreases. Such decrease in amplitude even though slight again reduces the efficiency of the cutting action.

BRIEF DESCRIPTION OF THE PRESENT INVENTION

With all of the foregoing considerations in mind, the present invention contemplates the provision of an improved animal grooming clipper overcoming the various problems associated with the prior art clippers described above.

More particularly, in accord with the present invention there is provided a casing for holding a clipper blade assembly, a drive motor separate from the casing, and a flexible shaft connected between the drive motor and casing for transferring power from the drive motor to the casing to drive the clipper blade assembly.

With the foregoing arrangement, the drive motor can have a rated horsepower and rpm substantially greater than that for motors of the type heretofore incorporated in prior art clipper casings. Further, because the motor is separate from the casing, the casing itself is lighter and will operate at a cooler temperature than would be the case were the motor incorporated in the casing. Finally, because of the increased power available through the flexible shaft connecting the motor to the casing, a substantially constant oscillation frequency can be maintained even under heavy loads.

In accord with another important feature of this invention, the conversion of the rotary shaft motion to an oscillating motion for driving the blades is accomplished without the use of any gearing, but rather through a simple and unique lever arrangement, all to the end that a consistent amplitude can be maintained even after prolonged use.

In the preferred embodiment, the clipper includes a stand which can be secured to the edge of a grooming table for supporting the drive motor at a desired level above the table. This stand is provided with a tray for holding clipper blade assemblies and a holder for holding the clipper casing when the clipper is not in use.

BRIEF DESCRIPTION OF THE DRAWINGS

A better understanding of this invention will be had by now referring to a preferred embodiment thereof as illustrated in the accompanying drawings in which.

DETAILED DESCRIPTION OF THE PREFERRED EMBODIMENT

Figure 1:
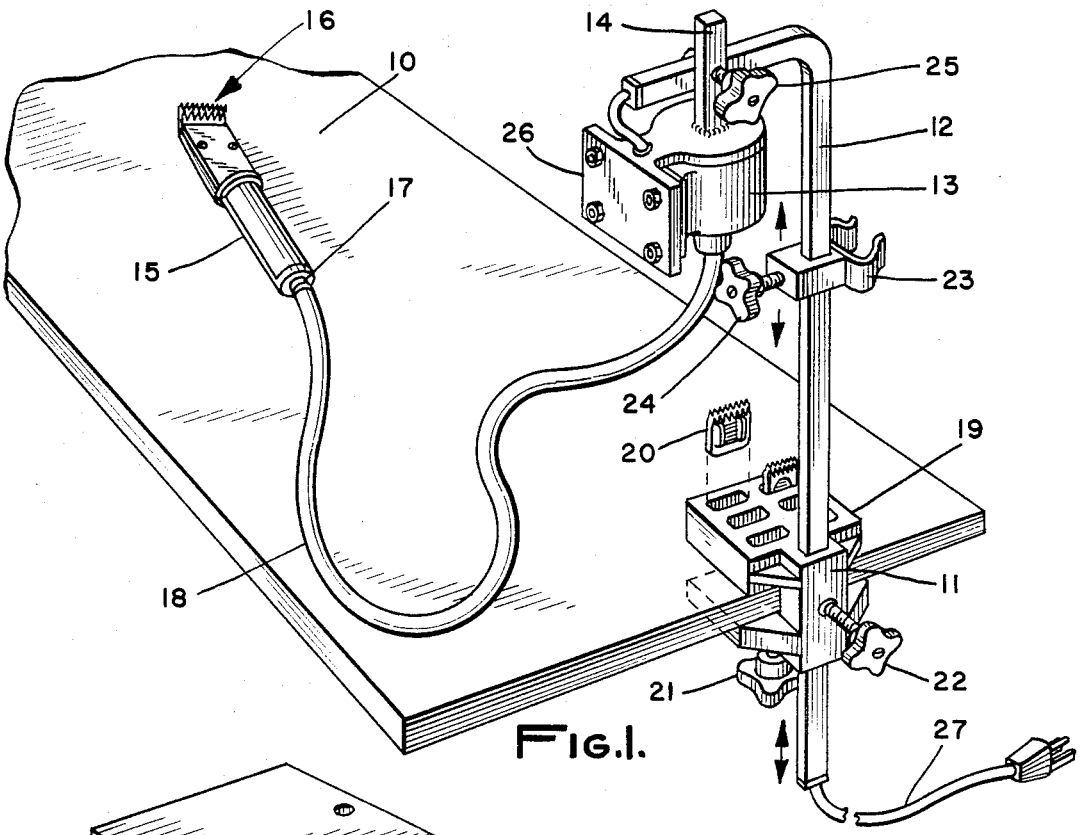
FIG. 1 is an overall perspective view of the improved animal grooming clipper of this invention.

Referring first to FIG. 1, there is shown a grooming table 10 with the improved clipper which includes a clamp stand 11, shown secured to an edge of the table 10 and including an upwardly extending support bar 12. An electric drive motor 13 is supported to the bar 12 as by an appropriate attachment means 14.

Drive motor 13 has a rated horsepower and rpm substantially greater than that for smaller drive motors normally incorporated within the casing of a clipper, all as described heretofore with respect to prior art clippers.

Still referring to FIG. 1, the improved clipper includes an elongated clipper casing 15 shown on the surface of the table 10 dimensioned intermediate its ends to be easily held with one hand. This casing includes a clipper blade assembly holder at its front end for holding a clipper blade assembly such as indicated at 16. The rear end of the casing 15 includes a flexible shaft coupling means 17 for connection to a flexible shaft 18 passing from the motor 13.

With the foregoing arrangement, the clipper casing 15 itself can be maintained relatively light and easily maneuverable since the drive motor therefor is separate. Moreover, as pointed out heretofore, the portion of the clipper held by a user will be relatively cool as compared to prior art type clippers incorporating a motor in the casing.

Referring once again to the clamp stand 11 as shown in FIG. 1, in accord with further features of the present invention, the clamp stand includes a tray structure 19 seated on a surface portion of the table adjacent to the table edge to which the clamp stand is secured for holding clipper blade assemblies in a convenient position for selection by a user of the clipper. One such clipper blade assembly is shown exploded above the tray 19 as at 20. It will be understood that the clipper blade assemblies are readily manually attachable and detachable from the front portion of the casing 15, the particular assembly blade holder for the casing enabling such substitution being well known in the art.

By positioning the tray 19 in surface engagement with the edge of the table 10, it can also serve as a part of the clamping structure, there being provided an underthreaded knob 21 which will engage the bottom edge of the table to clamp the table edge between the bottom of the tray and the knob.

In the embodiment illustrated in FIG. 1, the upwardly extending support bar 12 is vertically slidable in the clamp structure 11 and thereby the height of its upper end portion supporting the motor 13 above the level of the cable can be easily adjusted. This adjustment can be effected by loosening and then tightening knob 22 after vertically adjusting the position of the bar 12.

As a further convenience for a user, the stand includes on its upwardly extending support bar 12, a vertically adjustable spring clip means 23 for holding the casing 15 when the clipper is not being used. A threaded clamp knob 24 can be provided to secure the vertical position of the spring clip 23 along the bar 12 at a convenient height.

Referring now to the upper portion of the upstanding bar 12, the attachment means 14 for the motor 13 is held to the upper end of the support bar 12 as by a threaded knob 25. By unthreading the knob 25, the motor 13 can be separated from the upper portion of the support bar 12 and secured to an adjacent wall if such would be more convenient. Towards this end, the drive motor 13 includes a base mounting flange 26. It will be understood that if the motor is mounted to an adjacent wall, the grooming table would be in a permanent position and there would really be no necessity for the clamp stand 11. Thus, the power cord for the motor indicated at 27 would be pulled back through the support bar 12 and the stand not used.

Figure 2:
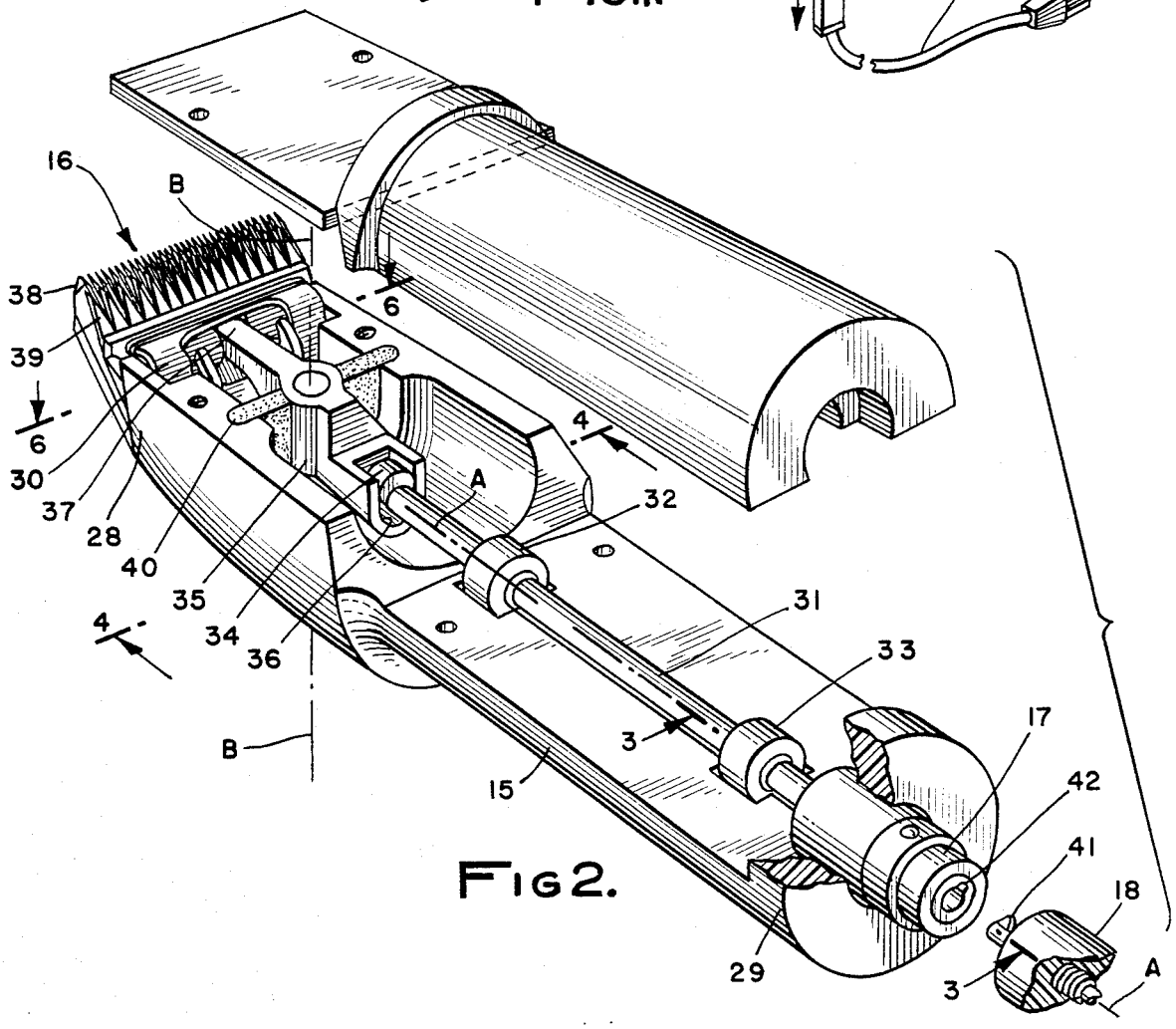
FIG. 2 is an enlarged exploded perspective view of the casing portion of the grooming clipper illustrated in FIG. 1.

Referring now to FIG. 2, details of the casing for the clipper and inner portions thereof will be described. In this respect, the upper half of the casing is shown exploded above the remaining portion to expose the interior thereof. The front and rear ends of the casing 15 are indicated at 28 and 29 respectively, the clipper blade assembly holder being shown at 30 for holding the clipper blade assembly 16.

Referring first to the central portion of FIG. 2, the casing includes an elongated shaft 31 extending along an axis A—A in the casing and bearingly supported as by bearing mounts 32 and 33. The forward end of the shaft 31 terminates short of the holder 30 and includes an eccentrically mounted drive disc 34. The rear end of the shaft 31, in turn, terminates in the flexible shaft coupling means 17 described in FIG. 1.

As shown in the forward end portion of the casing 15 there is provided a lever element 35 pivoted intermediate its ends for oscillating movement about an axis B—B normal to the axis A—A of the shaft. The rear end of this lever element terminates in a cavity 36 receiving the eccentric disc 34 so that rotation of the shaft 31 will result in the eccentric disc 34 bearing against the opposed walls of the cavity 36 to effect an oscillating movement of the lever element 35 by the disc.

The forward end of the lever element 35 as shown in FIG. 2 terminates in a drive finger 37 receivable in the clipper blade assembly 16 when the same is positioned in the clipper blade assembly holder 30. This finger will move back and forth as a consequence of the above-described oscillation of the lever 35 to thereby operate the clipper assembly 16. In this respect, the clipper assembly 16 as typical of all prior art clipper assemblies, includes stationary blade teeth 38 and movable blade teeth 39. The movement of the finger 37 back and forth will cause the movable blade teeth 39 to oscillate back and forth relative to the stationary blade teeth 38 thereby providing the desired shearing or cutting action of the clipper blades. Small opposed felt-like pads 40 on either side of the central portion of the lever element 35 will prevent hairs and the like from passing backwardly into the main portion of the casing. It will be understood that this main portion of the casing behind the felt-like pads 40 can be filled with appropriate lubricant.

Referring now to the rear end portion of the casing shown in FIG. 2 at 29, the flexible shaft coupling means 17 is arranged to cooperate with the flexible shaft 18 wherein the end of the rotating shaft includes a lateral projection 41 receivable in a slot 42 so that rotary motion will be transferred to the shaft 31.

Figure 3:
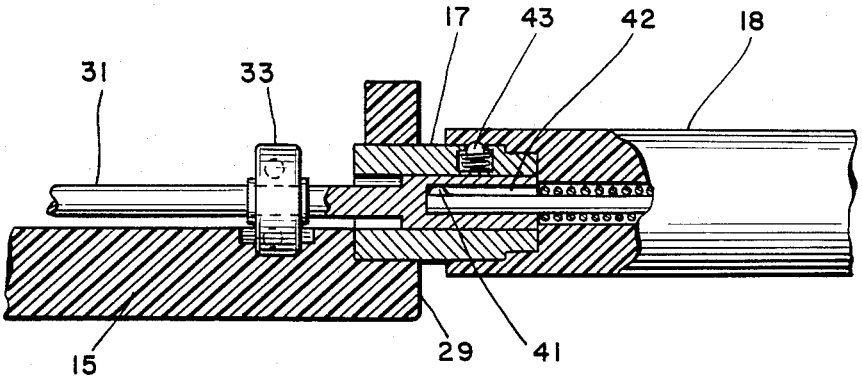
FIG. 3 is a fragmentary cross section taken in the direction of the arrows 3—3 of FIG. 2.

The foregoing in assembled relationship is illustrated in FIG. 3 wherein it will be noted that the flexible shaft coupling means 17 includes a ball detent 43 for holding the end 18 of the flexible shaft in connected relationship with the flexible shaft coupling means 17. In FIG. 3, the lateral projection 41 is illustrated received within the slot 42 so that rotary motion will be transferred to the shaft 31 as described. Any other appropriate flexible shaft coupling means could, of course, be used.

Referring now to FIGS. 4 through 7, the operation of the lever element 35 for converting rotary motion of the shaft 31 to oscillating motion for operating the movable blades of the clipper blade assembly as described in FIG. 2 will be better understood.

Figure 4:
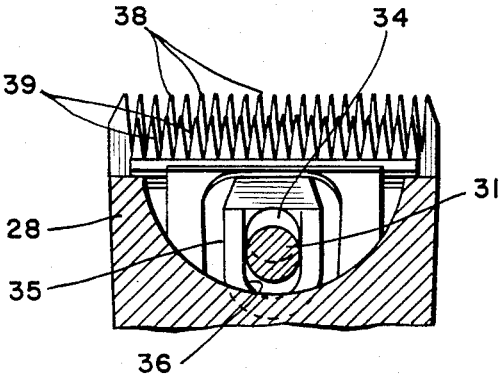
FIG. 4 is a fragmentary cross section taken in the direction of the arrows 4—4 of FIG. 2 showing the clipper blades in a central position.

Considering first the cross section of FIG. 4, the eccentric drive disc 34 is shown in an upwardly extending position from the end of the shaft 31. In this position, the movable blade teeth 39 are in a central position relative to the stationary blade teeth 38 and the lever element 35 is in alignment with the axis A—A of the shaft 31.

Figure 5:
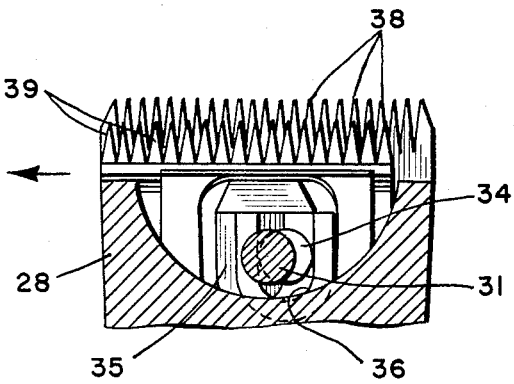
FIG. 5 is a cross section similar to FIG. 4, but showing the position of components when the blades have been moved to a side position.

Referring now to FIG. 5, the relative positions of the various components described in FIG. 4 are shown after the shaft 31 has made a quarter turn in a clockwise direction as viewed in FIG. 5. Thus, this quarter turn will position the eccentric drive disc 34 to the right as viewed in FIG. 5, thereby camming the rear end of the lever element 35 to the right so that the forward finger portion thereof will drive the movable blades 39 to the left; that is, to one side as indicated in FIG. 5.

After a further quarter turn to bring the eccentric disc 34 into a downwardly extending position, the movable blade teeth 39 will be moved back to a central position as indicated in FIG. 4 and a further quarter turn which will position the eccentric disc to the left as viewed in FIG. 5 will then cause the movable blades 39 to assume their right-hand-most position as viewed in FIG. 5.

Figure 6:
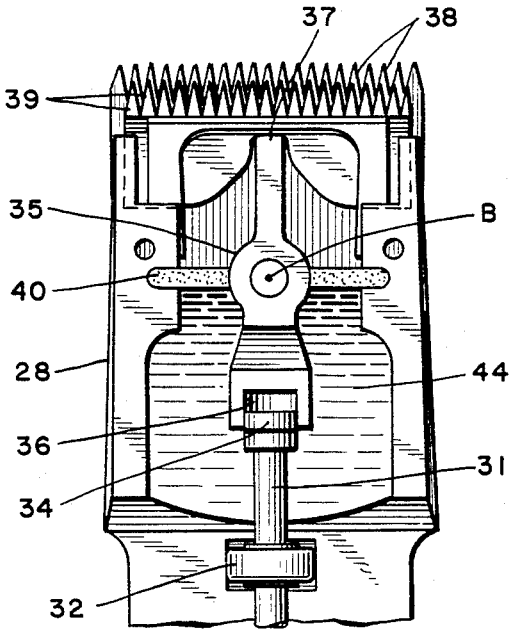
FIG. 6 is a fragmentary top plan view taken in the direction of the arrows 6—6 of FIG. 2 showing the position of various components when the blades are in a central position as depicted in FIG. 4.
Figure 7:
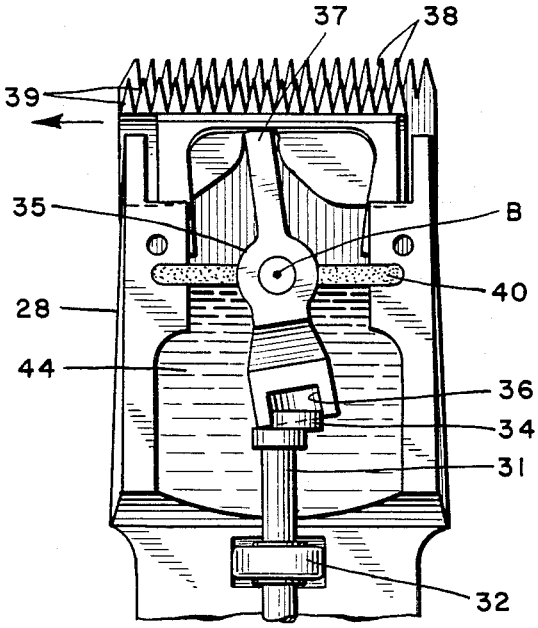
FIG. 7 is a view similar to FIG. 6 but illustrating the position of components when the blades are in the side position illustrated in FIG. 5.

The relative positions of the components illustrated in FIGS. 4 and 5 are reproduced in FIGS. 6 and 7 in plan view wherein it will be evident that as the rear portion of the lever element 35 is moved to the right, such as viewed in FIG. 7, the forward finger portion 37 will move to the left to drive the movable blades 39 to the one side position described.

In both FIGS. 6 and 7, it will be evident that the felt-like pads 40 on either side of the central portion of the finger element 35 will isolate the inner portion of the casing from the front area exposed to the blades and thus will block hairs or other debris from passing back into the mechanism. As also mentioned heretofore, there may be provided a lubricating medium such as grease indicated at 44 in FIGS. 6 and 7 to minimize friction and wear of the drive disc within the cavity 36 of the lever element.

Because of the greater horsepower available by use of a stationary motor separate from the casing and the flexible drive shaft, the amplitude of oscillation of the movable blades relative to the stationary blades can be made greater than the case where the motor is incorporated in the casing. Moreover, because of the available power, the frequency of oscillation can be maintained substantially constant even under heavy loading, all as described heretofore.

From all of the foregoing, it will now be evident that the present invention has provided a greatly improved animal grooming clipper exhibiting various advantages and avoiding the many problems associated with prior art clippers.

I claim:

1. An improved clipper to be used in place of a prior art clipper of the type incorporating a motor which is manually moved with the clipper for grooming an animal placed on the surface of a grooming table, said improved clipper comprising, in combination:

(a) a clamp stand for securement to an edge of said table and having an upwardly extending support bar;

(b) an electric drive motor having a rated horsepower and rpm substantially greater than that for said motor of said prior art clipper;

(c) attachment means for securing said drive motor to the upper end portion of said support bar;

(d) an elongated clipper casing having front and rear ends and dimensioned intermediate its ends to be easily held with one hand;

(e) a clipper blade assembly holder at the front end of said casing for holding a clipper blade assembly comprised of stationary blade teeth and movable blade teeth;

(f) an elongated shaft extending axially within and bearingly supported by said casing, the forward end of said shaft terminating short of said holder and including an eccentrically mounted drive disc, and the rear end of said shaft adjustment to the rear end of said casing having flexible shaft coupling means;

(g) a flexible shaft coupled at one end to said coupling means and at its other end to said drive motor; and (h) a lever element pivoted intermediate its ends in the forward portion of said casing for oscillating movement about an axis normal to the axis of said shaft, the rear end of said lever element terminating in a cavity receiving said eccentric disc so that rotation of said shaft will result in oscillating movement of said lever element by said disc, the forward end of said lever element terminating in a drive finger receivable in a clipper blade assembly when positioned in said clipper blade assembly holder to oscillate the movable blade teeth of the assembly relative to the stationary blade teeth whereby said greater horsepower and rpm of said drive motor assures that the shear oscillation frequency of the movable blade teeth is maintained substantially constant under load, said greater horsepower also permitting a greater amplitude of oscillation to be used compared to the amplitude of oscillation of said prior art clipper and whereby the use of said flexible cable results in less heat being generated in said casing and provides for a lighter and more easily manipulated clipper compared to said prior art clipper.

2. An improved clipper, according to claim 1, in which said clamp stand includes a tray structure seated on the surface portion of the table adjacent to the table edge to which the clamp stand is secured for holding clipper blade assemblies in a convenient position for selection by a user of the clipper.

3. An improved clipper according to claim 1, in which said clamp stand includes means for adjusting the height of said upper end portion of said support bar above the surface of said table.

4. An improved clipper according to claim 1, in which said stand includes on its upwardly extending support bar, a vertically adjustable spring clip means for holding said casing when the clipper is not being used.

5. An improved clipper according to claim 1, in which said attachment means for said drive motor permits manual removal of the motor and wherein said drive motor includes a base mounting flange so that the motor can be optionally mounted to a wall adjacent to said grooming table after removal from said support bar.

6. An improved clipper according to claim 1, in which said casing is made of a plastic material which need not be heat resistant and therefore can be made stronger than the casing material used for said prior art clippers.

* * * * *